US006689312B2

(12) United States Patent
Lakeland

(10) Patent No.: US 6,689,312 B2
(45) Date of Patent: Feb. 10, 2004

(54) ALLOY COMPOSITION AND IMPROVEMENTS IN MOLD COMPONENTS USED IN THE PRODUCTION OF GLASS CONTAINERS

(75) Inventor: Kenneth Donald Lakeland, Ormiston (AU)

(73) Assignee: SG Alternatives, L.L.C., East Hartford, CT (US)

( * ) Notice: Subject to any disclaimer, the term of this patent is extended or adjusted under 35 U.S.C. 154(b) by 73 days.

(21) Appl. No.: 09/997,087

(22) Filed: Nov. 28, 2001

(65) Prior Publication Data

US 2003/0099566 A1 May 29, 2003

(51) Int. Cl.[7] ..... C22C 38/32; C22C 38/54

(52) U.S. Cl. ..... 420/64; 420/60; 420/61; 420/104; 420/106; 420/121; 148/325; 148/330; 148/332

(58) Field of Search ..... 148/325, 332, 148/333, 334, 330; 420/60, 61, 64, 121, 106

(56) References Cited

U.S. PATENT DOCUMENTS 3,798,075 A * 3/1974 Bendel ..... 148/608
5,089,067 A * 2/1992 Schumacher ..... 148/325
5,641,453 A * 6/1997 Hackl et al. ..... 420/42
5,820,819 A * 10/1998 Tanabe et al. ..... 420/112
5,964,915 A * 10/1999 Neuman et al. ..... 65/214
6,110,300 A * 8/2000 Brada et al. ..... 148/325

* cited by examiner

*Primary Examiner*—Deborah Yee
(74) *Attorney, Agent, or Firm*—Robert S. Smith

(57) ABSTRACT

An alloy and article of manufacture including parts of glass container manufacturing apparatus such as a mold and plunger having a composition which consists of Carbon 0.1 to 0.5%, preferably 0.2 to 0.3%
Silicon 0 to 2% preferably 0.5 to 1.5%
Manganese 0 to 2% preferably 0.4 to 1.5%
Sulphur 0.02 to 0.05% (an incidental element)
Phosphorus 0.02 to 0.05% (an incidental element)
Nickel 0 to 3% preferably 1.0 to 1.5%
Chromium 5 to 35% preferably 15 to 20%
Molybdenum 0 to 5% preferably 0.1 to 0.3%
Copper 0 to 3% preferably 0.2 to 1%
Boron 0.5 to 3.5% preferably 1.8 to 2.2%.

The alloy and the articles of manufacture have having excellent high temperature characteristics and substantial hardenability.

30 Claims, 3 Drawing Sheets

ALLOY COMPOSITION AND IMPROVEMENTS IN MOLD COMPONENTS USED IN THE PRODUCTION OF GLASS CONTAINERS

BACKGROUND OF THE INVENTION

The manufacture of glass containers such as bottles, jars, and the like involves the shaping of the molten glass in a mold assembly, which consists of metallic components. The mold assembly is operated on an automatic machine they can produce glass bottles and jars at high production rates. Molten glass is dropped into a mold assembly at a temperature of about 1200 degrees Centigrade and is formed into a shape by the action of different components. Traditionally the mold is made of gray cast iron or bronze, and the internal components are made of a variety of steels, cast irons or nickel alloys.

The conditions inside glass container manufacturing apparatus are severe. There are frequent and severe temperature changes as the molten glass is introduced then ejected as a partly formed bottle in every machine cycle. Machine cycles can be a short as a few seconds. The components of the container manufacturing apparatus must be able to resist this thermal cycling without cracking.

SUMMARY OF THE INVENTION

It is an object of the invention to provide an alloy, having particular application to glass making apparatus such as molds and plungers for glass container manufacturing that can be made by standard melting and molding techniques used in ferrous foundry operations.

Another object of the invention is to provide an alloy that has a high hardness in the as cast condition and preferably as high as 55 Rockwell C.

Still another object of the invention is to provide an alloy that (a) can be heat treated to allow for machining operations to be carried out and (b) can re-hardened thereafter for service by standard normalizing and tempering procedures.

Yet another object of the invention is to provide glass making machinery components that have excellent service lives when employed as parts of glass bottle manufacturing apparatus and maintain sharp edges on surfaces in contact with molten glass longer than traditional materials.

Still another object invention is to provide apparatus that is capable of a substantial service life despite the severe and very frequent temperature cycling encountered within glass container manufacturing apparatus.

Is now been found that these and other objects of the invention may be attained in an alloy or an article of manufacture including but not limited to plunger and mold articles used in glass container manufacturing which consists of (a) carbon 0.1 to 0.5% by weight;

(b) silicon 0 to 2% by weight;

(c) manganese 0 to 2% by weight;

(d) sulphur 0.02 to 0.05% by weight;

(e) phosphorus 0.02 to 0.05% by weight;

(f) nickel 0 to 3% by weight;

(g) chromium 5 to 35% by weight;

(h) molybdenum 0 to 5% by weight;

(i) copper 0 to 3% by weight;

(j) boron 0.5 to 3.5% preferably 1.8 to 2.2%

(h) The balance of the composition is iron.

In some embodiments of the invention the component (i) copper is in the range 0.2 to 1% by weight; the component (a) carbon is in the range 0.2 to 0.3% by weight; the component (b) silicon is in the range 0.5 to 1.5% by weight and the component (c) manganese is in the range 0.4 to 1.5% of weight.

The component (f) nickel may be in the range 1.0 to 1.5% by weight; the component (g) chromium may be in the range 15 to 20% by weight; and the component (h) molybdenum is in the range 0.1 to 0.3% by weight. The component (j) boron may be in the range 1.8 to 2.2% by weight.

BRIEF DESCRIPTION OF THE DRAWING

The invention will be better understood by reference to the drawing in which.

DESCRIPTION OF THE PREFERRED EMBODIMENTS

Figure 1:
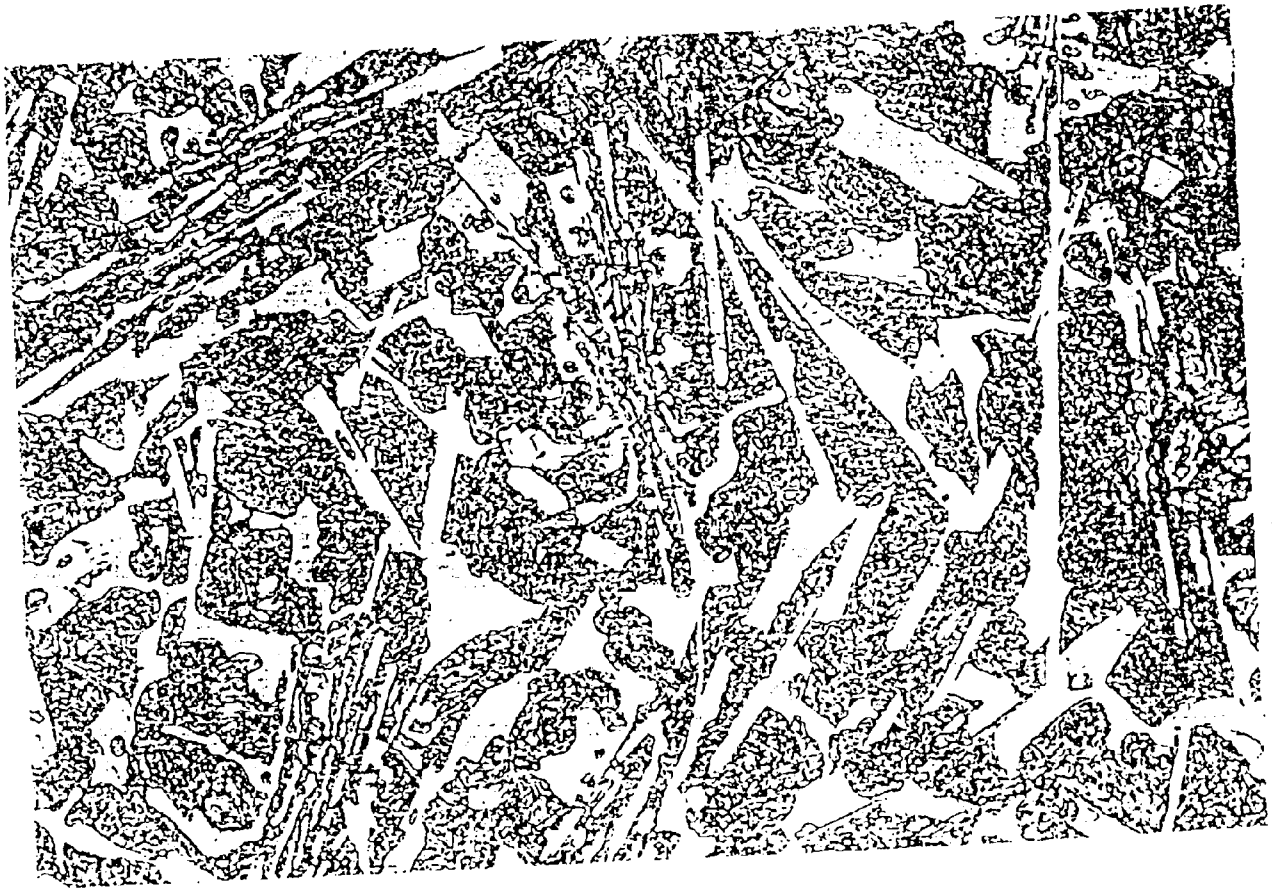
FIG. 1 is photo-micrograph shows the as-cast structure of a 30 mm diameter bar cast from the alloy detailed in example One. The structure consists of light colored iron-chromium-boron eutectic plates in a matrix of bainite and some retained austenite. The boride plates are interconnected in three dimensions. The bar was etched in ferric chloride acid. The magnification is 600×.

The present invention describes an iron-based alloy with chromium and boron additions, which gives the components longer service life and assists in the reduction or removal of certain defects which can affect the quality of the finished product. The increased service life allows an improvement in productivity of the machines and a reduction in downtime due to less frequent mold changes.

The alloy contains chromium and boron in a ferrous base so that iron-chromium-borides are precipitated in a ferrous matrix as a result of a ternary eutectic reaction between iron chromium and boron. The chromium level is high enough to give the alloy good corrosion and oxidation resistance, and the boron level is sufficient to have at least 20% of the structure as hard eutectic iron chromium borides. This level of eutectic borides is necessary to provide resistance to wear and erosion at the working temperature of the components in contact with molten glass.

The temperature of conditions in a glass container manufacturing apparatus are very high. There are frequent and severe temperature changes as the molten glass is introduced and then ejected as a partly formed bottle during every machine cycle. Machine cycles made be as little as a few seconds. In the alloy in accordance with present invention, it has been found that a ferrous product will best endure these thermal stresses if the carbon content of the alloy is low (0.2%) rather than high (0.8% to 3%) as is found in cast iron and tool steels.

An alloy that has a ferrous base is relatively inexpensive. If the alloy has a low carbon and high chromium content the component manufactured of the alloy will have a high resistance to thermal cracking and oxidation. The addition of boron to produce eutectic borides provides a high degree of wear resistance. Boron has a very low solid solubility in either the high temperature austenite phase or the low temperature ferrite phase and may be considered to be insoluble for all practical purposes. The wear resistance of the alloy can therefore be controlled by the boron level and the amount of eutectic borides present without interference in the properties of the matrix.

This is not the case with carbon based ferrous tool steels where the carbon is quite soluble at high temperatures and carbon can be dissolved from alloy carbides present in tool steels. This will reduce the wear resistance of the carbides and alter the properties of the matrix.

The properties of the matrix in the alloy in accordance with the present invention are controlled by those elements, which can dissolve in it independently of the amount of boron present. This allows independent control of the properties of the matrix with carbon and the traditional steel elements. The amount and hardness of the eutectic boride can be independently controlled with boron and boride forming elements such as chromium, molybdenum and vanadium or other boride forming elements such as tungsten, titanium, zirconium and niobium.

The properties of the alloy can then be controlled by independent manipulation of the matrix and eutectic borides by selection of elements that affect the matrix or eutectic or both.

This can give excellent flexibility in alloy design for different components. For instance, the addition of several percent of vanadium to an iron alloy with 2% boron will give a fully ferritic matrix with iron vanadium borides present. The addition of 10% nickel to the iron 15%, chromium 2% boron alloy will produce a fully austenitic matrix at room temperature.

The alloy in accordance with present invention is effectively an austenitic stainless steel with 20% of iron chromium borides in the matrix. This alloy has excellent oxidation resistance and is more resistant to wear than traditional austenitic stainless steels. There are substantial possibilities for alloy design for specific conditions using this philosophy.

The basic strategy or design philosophy for the alloy of the present invention is to provide both a matrix and a eutectic boride that is not soluble in the matrix. This combination allows the manipulation of the composition and properties of the matrix and the eutectic boride, independently of one another. This approach is very different from the traditional carbon based steels where alloy carbides can dissolve back into the matrix at high temperature and will then affect the properties of the matrix.

In the case of an alloy with 15% chromium and 2% boron, the high chromium content provides a resistance to corrosion and oxidation, and provides hard iron chromium borides for wear resistance. The low carbon content provides an ability to resist thermal cracking because the bainite or martensite in the heat treated matrix will be relatively tough, but the carbon content is sufficient to produce a hard but tough martensite and bainite to assist with wear resistance. The low carbon content also insures that the alloy can be welded. The alloy can be readily joined to mild steel by arc welding without extensive joint preparation and preheating.

This is not usually possible with high carbon tool steels and cast irons. Other elements may be present in the alloy from the raw materials of manufacture such as sulphur, phosphorus, and silicon and copper or may be deliberately added to assist in the hardenability and strength of the matrix. Manganese and nickel are particularly suitable for improving hardenability and strength.

There is an unexpected effect with copper. The combination of austenite saturated with boron and chromium at the normalizing temperature, with a small amount of copper, will produce a very high degree of hardenability such that a very heavy section up to 500 mm thick should completely transform to bainite with air-cooling. Oil or water quenching is not required. This effect was noted when one melt containing a residual copper content of 0.25% due to the inclusion of copper containing reinforcing bar in the steel scrap charge, was made by accident. The resulting castings exhibited a high and uniform hardness that establish that the inclusion of copper is decidedly beneficial. The extended hardenability was checked by testing in a dilatometer at very slow cooling from 1050 degrees Centigrade to room temperature. The dilatometer sample showed a bainite transformation at a cooling rate that was equivalent to air-cooling of a round section of casting of 500 mm thickness.

The composition of the alloy in accordance with the invention is:

Carbon 0.1 to 0.5%, preferably 0.2 to 0.3%

Silicon 0 to 2% preferably 0.5 to 1.5%

Manganese 0 to 2% preferably 0.4 to 1.5%

Sulphur 0.02 to 0.05% (an incidental element)

Phosphorus 0.02 to 0.05% (an incidental element)

Nickel 0 to 3% preferably 1.0 to 1.5%

Chromium 5 to 35% preferably 15 to 20%

Molybdenum 0 to 5% preferably 0.1 to 0.3%

Copper 0 to 3% preferably 0.2 to 1%

Boron 0.5 to 3.5% preferably 1.8 to 2.2%

The balance of the composition is iron.

These percentages are expressed in percentage by weight as are all percentages herein unless expressly specified otherwise. The alloy can be manufactured by standard foundry techniques by melting low carbon steel scrap and ferrous alloys in a coreless electric induction furnace. The ferrous and boron components are preferably added at the base of the furnace with the steel scrap. The melting temperature of the steel scrap is reduced, as the the scrap alloys with the other alloys, to about 1260 degrees Centigrade. The reduction in melting temperature helps reduce the attack of the boron on the furnace linings. The other components are then added to the molten metal gradually until all the additions are melted. As soon as the melting is completed the composition can be checked on an optical emission spectrograph and any adjustments can then be made. The temperature of the molten metal can be checked using an immersion thermocouple. The temperature of the molten metal should be kept at 1400 to 1450 degrees Centigrade and should not exceed 1600 degrees Centigrade. The power to the furnace can then be switched off for a few minutes to allow any slag to float to the surface and be skimmed off. The metal should be kept at about 1400 degrees Centigrade if any holding of the melt is required, and then increased to 1450 degrees Centigrade for pouring into the pouring ladle. The metal should be poured into molds without delay to produce the castings required. Standard foundry technology of gating and feeding design applicable to stainless steels can be employed to produce sound castings with the alloy in accordance with the present invention.

Figure 2:
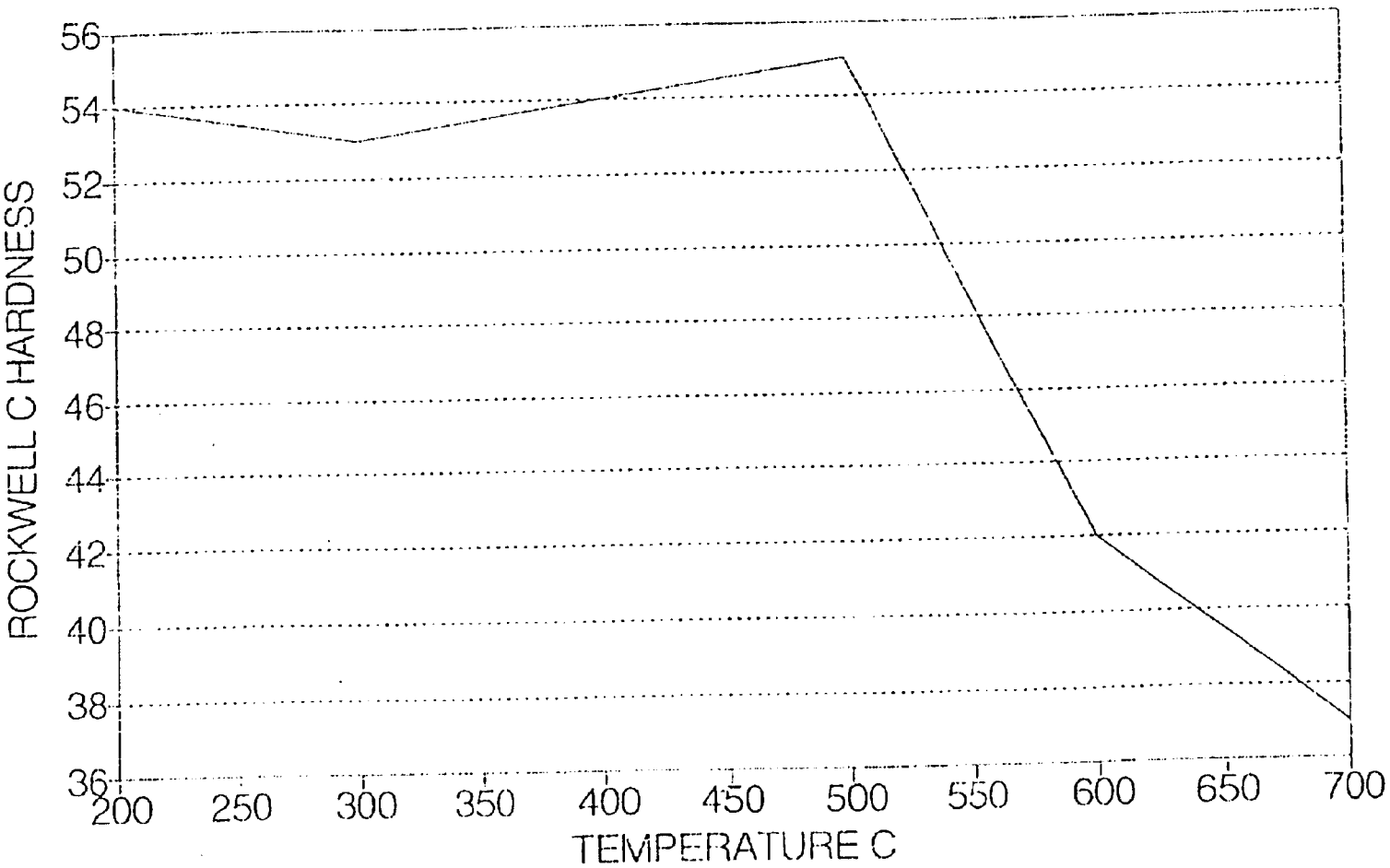
FIG. 2 is diagrammatic tempering curve for the 15% Cr, 2% B alloy after normalizing at 950 C. and air cooling. The hardness is measured after tempering for two hours at the respective tempering temperatures.

The structure of the as cast alloy, illustrated in FIG. 1, consists of partially transformed austenite and iron chromium eutectic boride. The eutectic borides are irregular in shape and form interconnected plates. The hardness of the as-cast alloy is high at about 55 Rockwell C and with up to 12% retained austenite together with martensite and bainite in the matrix, it is quite difficult to machine. The alloy can be heat treated using standard techniques and can be normalized at 950 to 1050 degrees Centigrade to homogenize the matrix and then air cooled to precipitate martensite and bainite. The component can then be sub-critically annealed at 650 to 700 degrees Centigrade, which will soften it to 35 Rockwell C ready for machining. After machining, normalizing at 950 to 1050 degrees Centigrade followed by tempering achieves the required hardness. The tempering curve is shown in FIG. 2. Quenching in oil or water from the normalizing temperature is not required to achieve maximum hardness because the hardenability of the alloy is very high.

After the components have been in use and replaced, the used components must be segregated from other materials before being returned to the parts maker for recycling.

Boron is detrimental to the properties of gray cast iron and most low carbon and alloy steels and it must not be allowed to enter the recycling chain of other materials in large quantities. The components may be incorporated into a furnace charge up to 50% of the charge weight without any deleterious effects. There is some loss of chromium and boron during the melting process, but the use of less steel scrap and ferro alloys make recycling cost effective. The analysis of a returns charge is checked and adjusted to the correct specification by a spectrograph in the same way as a fully new charge. The advantages of the components made from the high chromium-high boron alloy are as follows.

The alloy can be made by standard melting and molding techniques used in ferrous foundry operations. The alloy has a high hardness in the as cast condition up to 55 Rockwell C. The alloy can be heat treated to allow for machining operations to be carried out and the components can then be re-hardened for service by standard normalizing and tempering procedures. Components made from this alloy show excellent service as parts of glass bottle mold assemblies and keep a sharp edge in contact with molten glass longer than traditional materials. Service life increases of 100 to 200% are not unusual.

Components with excellent hardenability can be made from this alloy due to the combination of chromium and boron saturated matrix and a small amount of copper.

Castings of up to 500 mm in thickness would be expected to transform completely to bainite after normalizing by air cooling from 950 to 1050 degrees Centigrade to room temperature.

Some glass mold components that have high nickel content suffer from an effect of nickel leaching from the metal surface into the glass, causing internal stresses in the glass and lower fracture strengths. The alloy in accordance with the present invention does contains a high chromium and boron content, however, the alloy of the present invention does not suffer from this problem and can therefore improve the quality of the glass bottle and improve the yield of good bottles.

An additional advantage of the present invention is that articles or components manufactured from this alloy can be readily repair welded or welded to other components.

Figure 5:
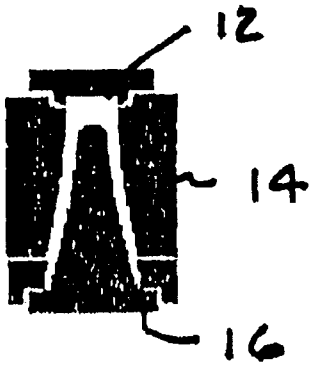
FIG. 5 is a diagrammatic view illustrating the closed mold with the plunger advanced within the mold to complete the initial forming off the glass container from the gob of glass.
Figure 4:
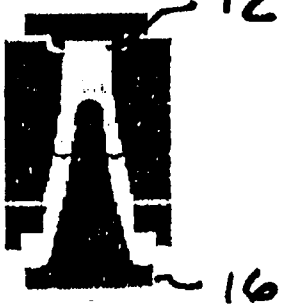
FIG. 4 is a diagrammatic view illustrating the closed mold with the plunger advanced to a position within the mold sufficiently to achieve some displacement of the glass within the mold.
Figure 3:
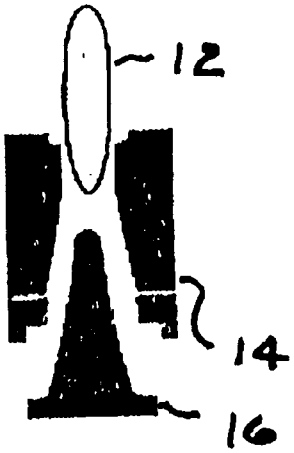
FIG. 3 is a diagrammatic view of a glass bottle making mold and plunger assembly, manufactured of an alloy in accordance with present invention, which is part of a large glass making apparatus that illustrates a gob of glass dropped into the mold.

FIGS. 3, 4, and 5 illustrate one form of the glass container forming apparatus used in the industry. More specifically, this apparatus is part of a press and blow process apparatus. The Figures represent sequential steps in a press and blow process. The process includes initial positioning of a gob of molten glass 12, which has previously been cut to a specific weight and shape, in a mold 14 as shown in FIG. 3. Thereafter, as shown in FIG. 4, the mold 14 is closed and a plunger 16 is pressed into the soft gob of glass 12 to create a preform, known as a parison. Thereafter the preform is typically moved to different apparatus in which the container is fully formed by a blowing process. The alloy in accordance with the present invention has particular application to the molds 14 the plunger 16 utilized in the press and blow process apparatus.

EXAMPLE

Components known as a mold 14 and a plunger 16 were made from the alloy with the following composition, carbon 0.25%, silicon 0.9%, manganese 0.95%, chromium 15.5%, nickel 1.25%, molybdenum 0.25%, copper 0.15% and the balance being other impurities and iron. The plunger was cast in a ceramic mold using the investment casting or lost wax process. The plunger was softened for machining and subsequently normalized and tempered to give a hardness of 45 to 48 Rockwell C. This hardness was chosen so that it would be comparable with that of a nickel alloy.

Six of these plungers were put into six glass molds on a 12 station machine making glass beer bottles. The other six molds were fitted with plungers made from a nickel alloy hardened to 45 Rockwell C. The nickel alloy was a standard alloy that has been used in the glass industry for many years. The nickel alloy plungers were replaced after three weeks operation on the machine to re sharpen a fine ledge on the stem of the plunger. This was considered to be a normal life for these plungers. The chromium/boron alloy in accordance with the composition of the present invention was used to manufacture plungers that lasted on the machine for twelve weeks before they were removed for resharpening. This was considered to be very beneficial as it not only improved the overall life of the plungers, but the cost of downtime was considerably reduced, allowing greater productivity from the machine.

Testing the alloy in accordance with the present invention and articles manufactured of the alloy and particularly glassware manufacturing apparatus has confirmed that all of the noted objects of the invention are achieved. Those skilled in the art will recognize that the durability and weldability of the alloy and articles in accordance with the invention will have many other applications.

While the invention has particular application to parts of glass container manufacturing apparatus you'll be understood that the high temperature characteristics and excellent hardenability characteristics of the alloy and parts manufactured of the alloy in accordance with the present invention have application to many other articles of manufacture.

The invention has been described with reference to the preferred embodiments. Persons skilled in the art of such inventions may upon exposure to the teachings herein, conceive other variations. Such variations are deemed to be encompassed by the disclosure, the invention being delimited only by the following claims.

Having thus described my invention I claim:

1. An alloy having excellent high temperature characteristics and substantial hardenability which consists of:

(a) carbon 0.1 to 0.5% by weight;

(b) silicon 0 to 2% by weight;

(c) manganese 0 to 2% by weight;

(d) sulphur 0.02 to 0.05%by weight;

(e) phosphorus 0.02 to 0.05% by weight;

(f) nickel 0 to 3% by weight;

(g) chromium 5 to 35% by weight;

(h) molybdenum 0 to 5% by weigh;

(i) cooper 0 to 3% by weight;

(j) boron 0.5 to 35% by weight; and (h) The balance of the composition is iron.

2. The alloy in accordance with claim 1 in which the component (i) copper is in the range 0.2 to 1% by weight.

3. The alloy in accordance with claim 1 in which the component (a) carbon is in the range 0.2 to 0.3% by weight.

4. The alloy in accordance with claim 1 in which the component (b) silicon is the range 0.5 to 1.5% by weight.

5. The alloy in accordance with claim 1 in which the component (c) manganese is in the range 0.4 to 1.5% of weight.

6. The alloy in accordance with claim 1 in which the component (f) nickel is in the range 1.0 to 1.5% by weight.

7. The alloy in accordance with claim 1 in which the component (g) chromium is in the range 15 to 20% by weight.

8. The alloy in accordance with claim 1 in which the component (h) molybdenum is in the range 0.1 to 0.3% by weight.

9. The alloy in accordance with claim 1 in which the component (j) boron is in the range 1.8 to 2.2% by weight.

10. The alloy in accordance with claim 1 in which the component (a) carbon is in the range 0.2 to 0.3% by weight;

(b) silicone is in the range 0.5 to 1.5% by weight;

(c) manganese is in the range 0.4 to 1.5% of weight;

(f) nickel is in the range 1.0 to 1.5% by weight;

(g) chromium is in the range 15 to 20% by weight;

(h) molybdenum is in the range 0.1 to 0.3% by weight;

(j) boron is in the range 1.8 to 2.2% by weight; and (i) copper is in the range 0.2 to 1% by weight.

11. An article of the manufacture having excellent high temperature characteristics and substantial hardenability which consists of:

(a) carbon 0.1 to 0.5% by weight;

(b) silicon 0 to 2% by weight;

(c) manganese 0 to 2% by weight;

(d) sulphur 0.02 to 0.05% by weight;

(e) phosphorus 0.02 to 0.05% by weight;

(f) nickel 0 to 3% by weight;

(g) chromium 5 to 35% by weight;

(h) molybdenum 0 to 5% by weight;

(i) copper 0 to 3% by weight;

(j) boron 0.5 to 3.5% by weight; and (h) The balance of the composition is iron.

12. The article of manufacture in accordance with claim 11 in which the component (i) copper is the range 0.2 to 1% by weight.

13. The article of manufacture in accordance with claim 11 in which the component (a) carbon is the range 0.2 to 0.3% by weight.

14. The article of manufacture in accordance with claim 11 in which the component (b) silicon is the range 0.5 to 1.5% by weight.

15. The article of manufacture in accordance with claim 11 in which the component (c) manganese is the range 0.4 to 1.5% of weight.

16. The article of manufacture in accordance with claim 11 in which the component (f) nickel is the range 1.0 to 1.5% by weight.

17. The article of manufacture in accordance with claim 11 in which the component (g) chromium is the range 15 to 20% by weight.

18. The article of manufacture in accordance with claim 11 in which the component (h) molybdenum is the range 0.1 to 0.3% by weight.

19. The article of manufacture in accordance with claim 11 in which the component (j) boron is the range 1.8 to 2.2% by weight.

20. The article of manufacture in accordance with claim 1 in which the component (a) carbon is in the range 0.2 to 0.3% by weight;

(b) silicon is in the range 0.5 to 1.5% by weight;

(c) manganese is in the range 0.4 to 1.5% by weight;

(f) nickel is in the range 1.0 to 1.5% by weight;

(g) chromium is in the range 15 to 20% by weight;

(h) molybdenum is in the range 0.1 to 0.3% by weight;

(j) boron is in the range 1.8 to 2.2% by weight; and (i) copper is in the range 0.2 to 1% by weight.

21. A plunger and mold for use in a glass container manufacturing process having excellent high temperature characteristics and substantial hardenability which consists of:

(a) carbon 0.1 to 0.5% by weight;

(b) silicon 0 to 2% by weight;

(c) manganese 0 to 2% by weight;

(d) sulphur 0.02 to 0.05% by weight;

(e) phosphorus 0.02 to 0.05% by weight;

(f) nickel 0 to 3% by weight;

(g) chromium 5 to 35% by weight;

(h) molybdenum 0 to 5% by weight;

(i) copper 0 to 3% by weight;

(j) boron 0.5 to 3.5% by weight; and (h) The balance of the composition is iron.

22. The plunger and mold in accordance with claim 21 in which the component (i) copper is in the range 0.2 to 1% by weight.

23. The article of manufacture in accordance with claim 21 in which the component (a) carbon is in the range 0.2 to 0.3% by weight.

24. The article of manufacture in accordance with claim 21 in which the component (b) silicon is in the range 0.5 to 1.5% by weight.

25. The article of manufacture in accordance with claim 21 in which the component (c) manganese is in the range 0.4 to 1.5% of weight.

26. The article of manufacture in accordance with claim 21 in which the component (f) nickel is in the range 1.0 to 1.5% by weight.

27. The article of manufacture in accordance with claim 21 in which the component (g) chromium is in the range 15 to 20% by weight.

28. The article of manufacture in accordance with claim 21 in which the component (h) molybdenum is in the range 0.1 to 0.3% by weight.

29. The article of manufacture in accordance with claim 21 in which the component (j) boron is in the range 1.8 to 2.2% by weight.

30. The article of manufacture in accordance with claim 21 in which the component (a) carbon is in the range 0.2 to 0.3% by weight;

(b) silicon is in the range 0.5 to 1.5% by weight;

(c) manganese is in the range 0.4 to 1.5% of weight;

(f) nickel is in the range 1.0 to 1.5% by weight;

(g) chromium is in the range 15 to 20% by weight;

(h) molybdenum is in the range 0.1 to 0.3% by weight;

(j) boron is in the range 1.8 to 2.2% by weight; and (i) copper is in the range 0.2 to 1% by weight.

* * * * *